United States Patent [19]

Bannister

[11] 4,368,814

[45] Jan. 18, 1983

[54] APPARATUS FOR FRANKING MAIL

[75] Inventor: Raymond L. Bannister, Richmond, England

[73] Assignee: Pitney Bowes Inc., Stamford, Conn.

[21] Appl. No.: 172,091

[22] Filed: Jul. 25, 1980

Related U.S. Application Data

[63] Continuation-in-part of Ser. No. 903,289, May 4, 1978, abandoned.

[51] Int. Cl.[3] ..... G07F 17/42

[52] U.S. Cl. ..... 194/1 A; 194/DIG. 8

[58] Field of Search ..... 194/DIG. 8, DIG. 9, 194/1 A, 1 R, 10, 51, 59, 2

[56] References Cited

U.S. PATENT DOCUMENTS 2,960,377 11/1960 Simjian ..... 194/4 C 3,757,917 9/1973 Walwood et al. ..... 194/10

4,176,740 12/1979 Tzu-Yen ..... 194/DIG. 8

FOREIGN PATENT DOCUMENTS 2430413 1/1976 Fed. Rep. of Germany ... 194/DIG. 8

*Primary Examiner*—Stanley H. Tollberg

*Attorney, Agent, or Firm*—Peter Vrahotes; Albert Scribner; William D. Soltow, Jr.

[57] ABSTRACT

A coin freed apparatus for franking mail having a cabinet with two entry slots for the introduction of mail and coins respectively. A franking machine is mounted in the cabinet and is automatically operable to mark each item of mail fed through the appropriate entry slot with a stamp of a predetermined value. A mechanism is operable in response to the insertion of a coin of the predetermined value to forward an item of mail introduced into the appropriate entry slot through the franking machine.

6 Claims, 4 Drawing Figures

APPARATUS FOR FRANKING MAIL

This is a Continuation-in-Part of U.S. Application Ser. No. 903,289, filed on May 4, 1978 abandoned.

This invention relates to apparatus for franking mail.

Postal franking machines are widely used in offices for the purpose of stamping mail without the need for purchasing and applying adhesive stamps and it is the object of the present invention to provide franking apparatus which can be installed in or outside post offices, in hotels, offices, hospitals, etc., or in ships, where it can be used by the general public upon inserting a coin.

To this end, according to the invention, coin feed apparatus for franking mail comprises a cabinet having two entry slots for the introduction of mail and coins respectively, a franking machine mounted in said cabinet and automatically operable to mark each item of mail fed thereto with a stamp of the same predetermined value and mechanism operable in response to the insertion of a coin of at least said predetermined value to forward an item of mail introduced into the appropriate entry slot, through said franking machine.

By suitably positioning the cabinet in a hole in a wall it is possible for mail inserted therein by members of the public to pass directly from the cabinet into a security area after franking.

The apparatus according to the invention, permits of reducing the number of counter clerks required in post offices for selling stamps, eliminates the necessity for cancelling adhesive stamps on envelopes, reduces sorting time, speeds delivery and makes it possible for members of the public to stamp and mail letters at any time of the day or night without having to wait for a post office to open.

One embodiment of the invention will now be described by way of example, with reference to the accompanying diagrammatic drawings in which.

Figure 1:
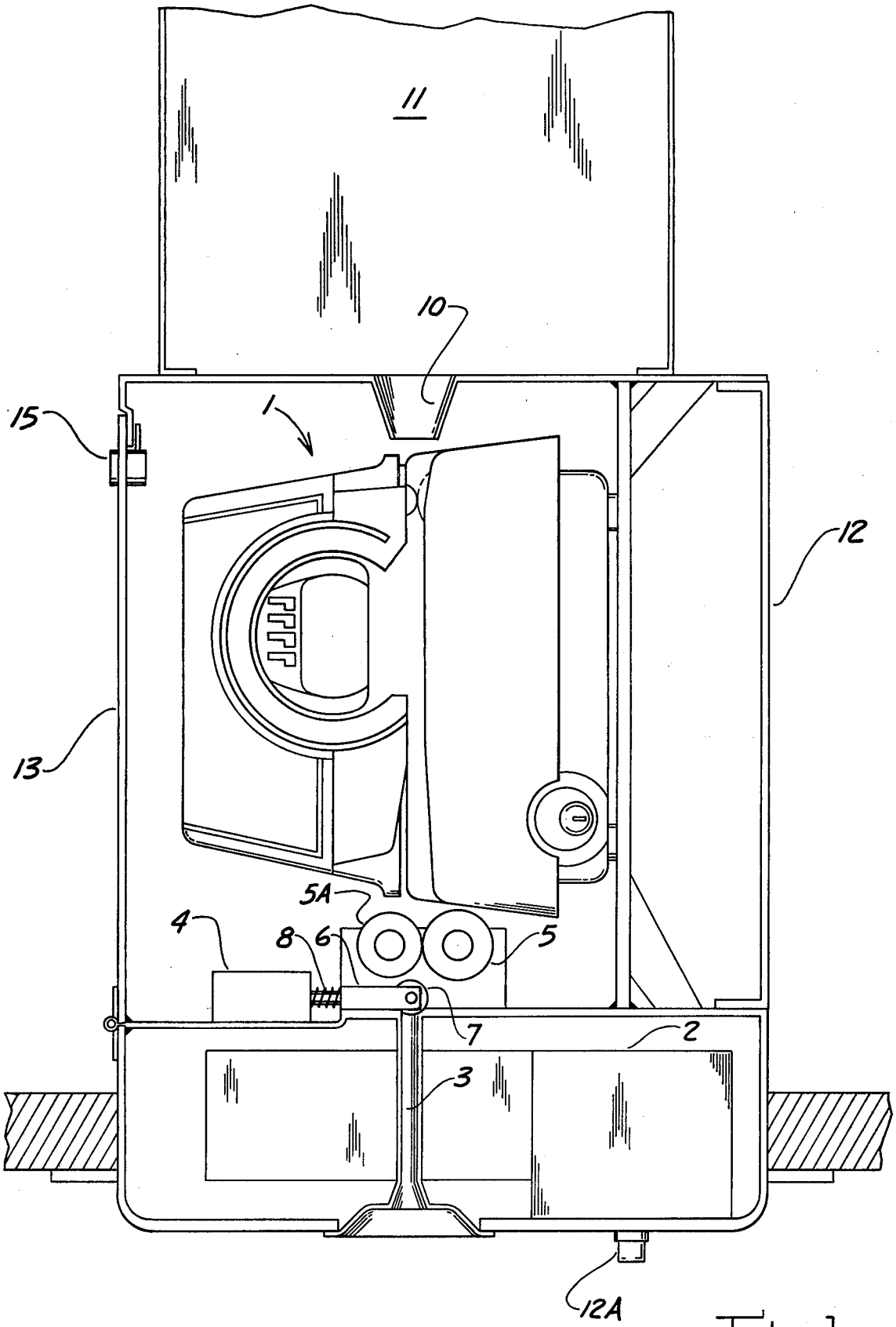
FIG. 1 represents a plan view of the apparatus with the top of the cabinet removed.
Figure 2:
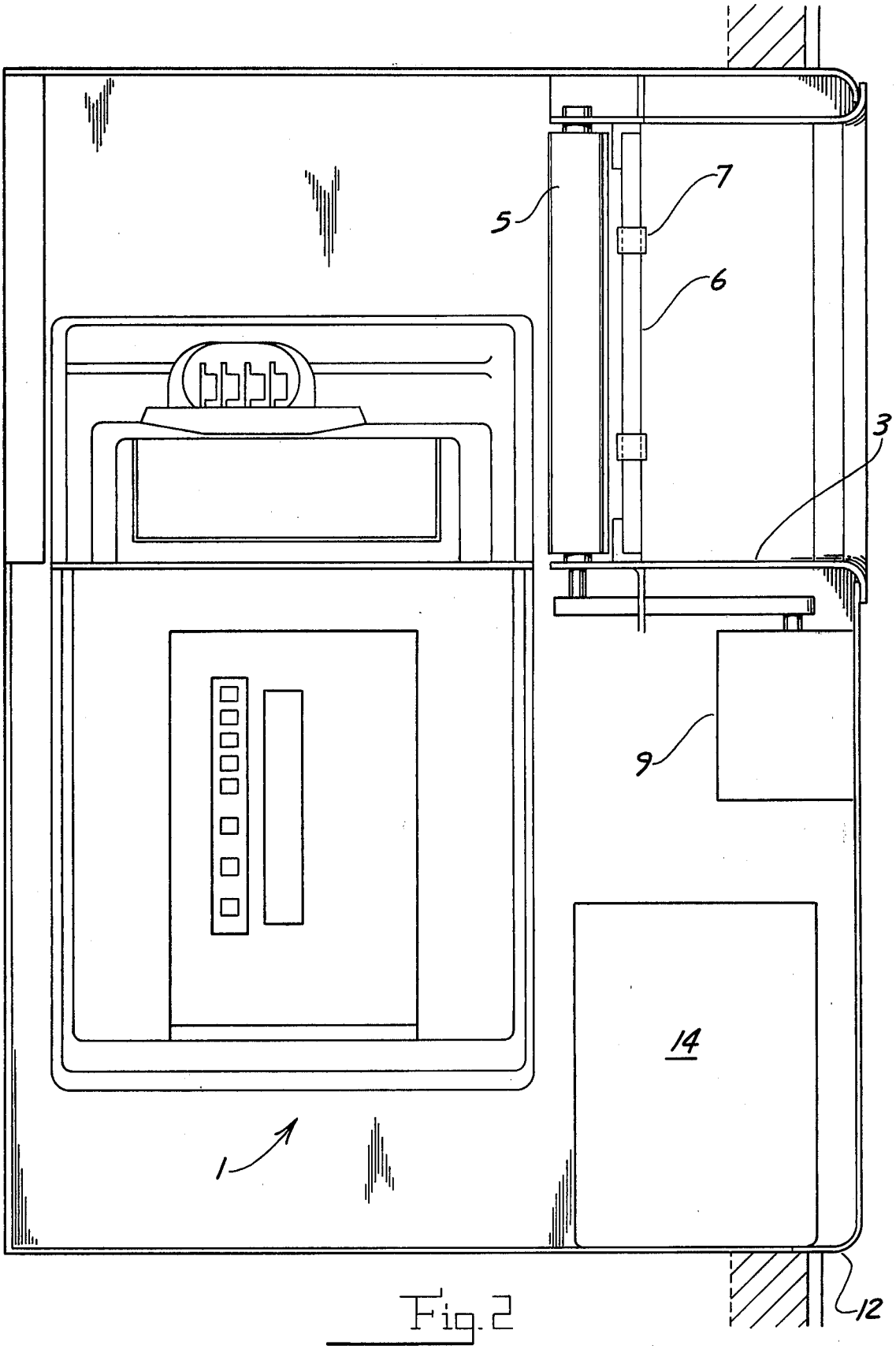
FIG. 2 represents a side view of the apparatus with one side and the door of the cabinet removed.
Figure 3:
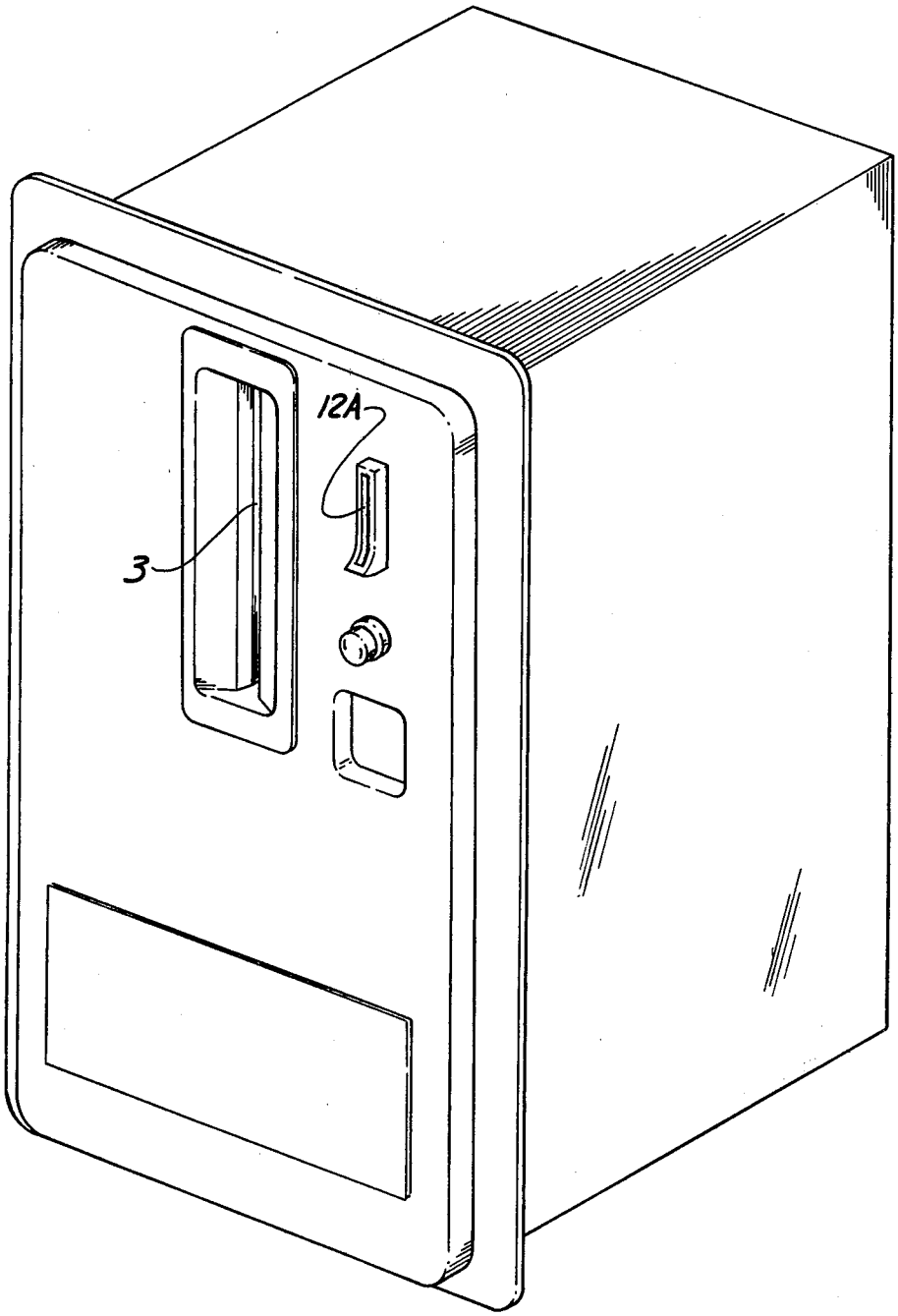
FIG. 3 represents an isometric view of the cabinet.

As shown in the drawings, a franking machine 1, for example a Pitney Bowes Model 6300 which is described in U.S. Pat. Nos. 3,682,378; 3,781,068 and 3,823,666, which can be preset to apply to each letter fed thereto, a stamp of the same predetermined value, (say 10p), is mounted in a steel cabinet 12 which also contains mechanism 2, operable upon insertion, in a slot 12A in the front of the cabinet, of a coin of at least the same value as that to which the franking machine is presently set, to allow a letter to be pushed through an entry slot 3 in the front of the cabinet and fed by rollers 5 and 5A through the franking machine. The coin actuated mechanism is of the same type as is used in vending machines and such mechanisms are readily commercially available from suppliers such as Eurocoin Ltd.

The slot 3 is preferably no more than 1/4" wide to prevent the entry of unacceptably thick items and is so arranged that letters are inserted with the longer dimension of the envelope extending vertically to ensure correct alignment with the dies of the franking machine 1 regardless of the width of individual envelopes.

Figure 4:
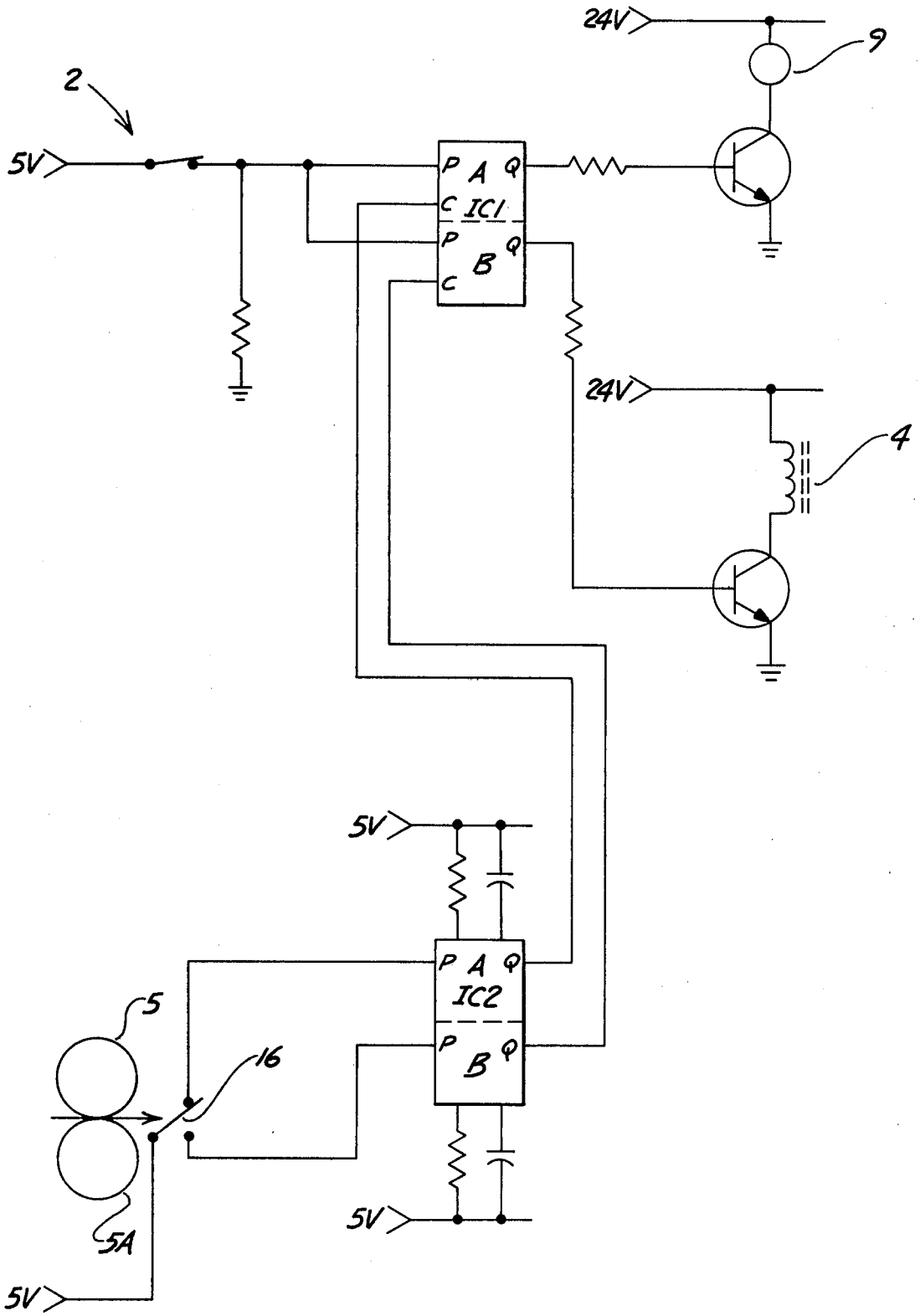
FIG. 4 represents a circuit diagram used to control various components of the apparatus shown in FIG. 1.

The coin-freed mechanism 2 is operable to close circuits through a solenoid 4, energisation of which opens a gate 6 at the inner end of the slot 3 and through a motor, shown at 9 combined with a gear box, for driving the roller 5 which, with the roller 5A, sets upon a letter pushed through the open slot 3 into the nip between them and feeds it into the franking machine 1 operation of which is triggered by the entry of the letter. The roller 5A is capable of yielding against the action of a spring upon entry of a letter between the rollers and on yielding operates a switch 16 in the circuit, shown in FIG. 4, through the solenoid 4 to deenergise the latter. Initially the motor 9 and solenoid 4 will be at rest due to both clear inputs on Ic-1 having been pulsed by a negative pulse from Ic-2, or due to the set up conditions established at power "ON". No operation will take place until the coin-freed mechanism 2 is activated by a coin. At this time the P input on Ic-1 1-A and 1-B will go zero operating a high at the Q outputs turning on both the solenoid 4 and motor 9. As the letter separates the feed rollers 5, 5A the roller sensing switch 16 will switch over putting a positive pulse into the input of Ic 2-B. This will generate a short negative pulse from its Q output. This negative pulse will cause Ic 1-B to reset turning off the solenoid 4. Once the envelope has passed completely through the rollers the sensing switch 16 will return to its "OFF" position. This action will generate a positive pulse into Ic 2-A input consequently generating a short negative pulse on its output Q. This negative pulse will reset Ic 1-A and switch off the motor 9, ready for the next operation. Upon deenergisation of the solenoid 4 a spring 8 returns the gate 6 towards its closed position and rollers 7 rotatably mounted on the inner end of the gate engage and roll on one surface of the envelope until the latter has passed out of the slot 3, whereupon the gate closes completely to prevent the entry of a second envelope until another coin is inserted. This system prevents fraudulent use of the apparatus when franking letters contained in envelopes of different lengths.

The franking machine 1 is operable to receive a letter from the rollers 5 and 5A, frank it and afterwards eject it through a slot 10 into a receptacle 11 positioned in a security area of the building or ship, where it can be collected by Post Office or other suitably authorized staff without the possibility of any outside interference.

A hinged door 13, fitted with a safety lock 15, is provided on one side of the cabinet 12 to give only authorized staff access to the franking machine 1 for reading the meter, setting the value and date wheels, removing the coins from a coin box 14, replenishing the ink roller, etc. The meter is of the "current account" type having only a total counter for registering the money collected and the adjustable setting levers are set at a predetermined value (in this case 10p) and are only capable of being reset by suitable authorized staff.

The provision of a coin-operated gate prevents paper or other objects from being pushed into the cabinet and since the slot 3 is only opened when a coin of at least the correct value is inserted in the slot 12A and closes again as soon as a letter has passed fraudulent use is prevented.

When two letters are fed into the slot 3 together only one will be franked and arrangements should be made for returning any unfranked letters passing through the apparatus to the sender.

The coin-freed mechanism may be of the kind which is only operable in response to the insertion of coins of a single value and means provided to reject coins of other denominations inserted in the slot 12A. Alternatively, the coin-freed mechanism may also be operable in response to the insertion of coins of a value greater than that to which the franking machine is set and means provided for giving the appropriate change.

What we claim is:

1. Coin-freed apparatus for franking mail, comprising a cabinet having entry slots for the introduction of mail and coins respectively, a franking machine mounted in said cabinet and automatically operable to mark each item of mail fed thereto with a stamp of the same predetermined value and conveying mechanism operable in response to the insertion of a coin of at least said predetermined value, to convey an item of mail, introduced into the appropriate entry slot, through said franking machine, said conveying mechanism including a gate normally closing the inner end of said mail slot and connected to a solenoid which is energized to open said gate upon insertion of an appropriate coin in the coin slot, one end of said gate being provided with a rotatable roller which contacts one surface of a mail item passing through the mail slot when the gate is open.

2. Apparatus according to claim 1, wherein said conveying mechanism includes a pair of rollers positioned inwardly of said gate and means responsive to the insertion of a coin for rotating at least one of said rollers whereby mail items may be conveyed from the mail slot to said franking machine when said one roller is driven by said rotating means.

3. Apparatus according to claim 2, wherein said mail slot is arranged with its longer dimension parallel to the axis of said rollers.

4. Apparatus according to claim 1 wherein said franking machine is operable automatically upon entry of a mail item therein.

5. Apparatus according to claim 4 wherein the value setting mechanism of said franking machine is adjustable.

6. Apparatus according to claim 1 including mechanism for giving change for coins of greater value than that for which the franking machine is set.

* * * * *

UNITED STATES PATENT AND TRADEMARK OFFICE

CERTIFICATE OF CORRECTION

PATENT NO. : 4,368,814

DATED : January 18, 1983

INVENTOR(S) : R. L. Bannister

It is certified that error appears in the above—identified patent and that said Letters Patent is hereby corrected as shown below:

Column 1, line 50, Patent No. "3,781,068" should read --3,731,068--.

Signed and Sealed this

Sixth Day of September 1983

[SEAL]

*Attest:*

GERALD J. MOSSINGHOFF

*Attesting Officer*

*Commissioner of Patents and Trademarks*